US009058803B2

(12) United States Patent
Daniel et al.

(10) Patent No.: US 9,058,803 B2
(45) Date of Patent: Jun. 16, 2015

(54) MULTICHANNEL AUDIO STREAM COMPRESSION

(75) Inventors: Adrien Daniel, Antibes (FR); Rozenn Nicol, La Roche Derrien (FR)

(73) Assignee: Orange, Paris (FR)

( * ) Notice: Subject to any disclaimer, the term of this patent is extended or adjusted under 35 U.S.C. 154(b) by 410 days.

(21) Appl. No.: 13/581,012

(22) PCT Filed: Feb. 10, 2011

(86) PCT No.: PCT/FR2011/050282

§ 371 (c)(1), (2), (4) Date: Aug. 24, 2012

(87) PCT Pub. No.: WO2011/104463

PCT Pub. Date: Sep. 1, 2011

(65) Prior Publication Data

US 2012/0314878 A1 Dec. 13, 2012

(30) Foreign Application Priority Data

Feb. 26, 2010 (FR) ..... 10 51420

(51) Int. Cl.
*H04R 5/00* (2006.01)
*G10L 19/008* (2013.01)
*G10L 19/20* (2013.01)

(52) U.S. Cl.
CPC ..... *G10L 19/008* (2013.01); *G10L 19/20* (2013.01)

(58) Field of Classification Search
CPC ..... H04R 5/00; G10L 19/00; G10L 21/00; G10L 19/008
USPC ..... 381/17, 22–23; 704/500, E19.001
See application file for complete search history.

(56) References Cited

U.S. PATENT DOCUMENTS 7,680,670 B2 * 3/2010 Lamblin et al. ..... 704/500
8,817,991 B2 * 8/2014 Jaillet et al. ..... 381/22

FOREIGN PATENT DOCUMENTS

WO WO 2009/067741 A1 6/2009

OTHER PUBLICATIONS

Arberet, "Robust estimation and blind learning of models for audio source separations," Thesis of the University of Rennes 1, pp. 1-193 (2008).

(Continued)

*Primary Examiner* — Disler Paul
(74) *Attorney, Agent, or Firm* — Drinker Biddle & Reath LLP

(57) ABSTRACT

A method for compressing an audio stream, including a plurality of signals, describing a sound scene produced by a plurality of sources in a space, by: identifying the sources from an audio stream; determining a frequency band, energy level and spatial position in the space for each of the identified sources; determining, for each identified source, a spatial resolution corresponding to the smallest difference in position of said source in the space which a listener is capable of perceiving, on the basis of: the frequency band, the energy level, and the spatial position of said source; and, on the frequency band, energy level, and spatial position of at least one subset of the other identified sources; generating a compressed stream comprising the information required to restore each identified source with at least the same corresponding spatial resolution.

13 Claims, 2 Drawing Sheets

(56) References Cited

OTHER PUBLICATIONS

Daniel, "Acoustic Field Representation, Application to the Transmission and the Reproduction of Complex Sound Environments in a Multimedia Context," PhD Thesis, University of Paris 6, pp. 1-319 (Jul. 2001).
Hellerud et al., "Encoding Higher Order Ambisonics with AAC," AES Convention 124, Amsterdam, The Netherlands May 17-20, 2008, AES, New York, USA, pp. 1-8 (May 2008).
Mills, "On the Minimum Audible Angle," The Journal of the Acoustical Society of America, vol. 30(4), pp. 237-246 (Apr. 1958).
Moore et al., "Exploiting Human Spatial Resolution in Surround Sound Decoder Design," AES Convention 125, San Francisco, CA, USA, Oct. 2-5, 2008, AES, New York, USA, pp. 1-9 (Oct. 2008).
Moreau, "Research and realization of advanced spatial encoding tools for the Higher Order Ambisonics spatialization technique: 3D microphone and distance control," University of Maine, Le Mans, France, pp. 1-202 (2006).
Pomberger et al., "An Ambisonics Format for Flexible Playback Layouts," Ambisonics Symposium 2009, Jun. 25-27, Graz, pp. 1-8 (2009).
Saberi et al., "Free-field release from masking," Journal of the Acoustical Society of America, vol. 90 (3), pp. 1355-1370 (Sep. 1991).

* cited by examiner

FIG. 3
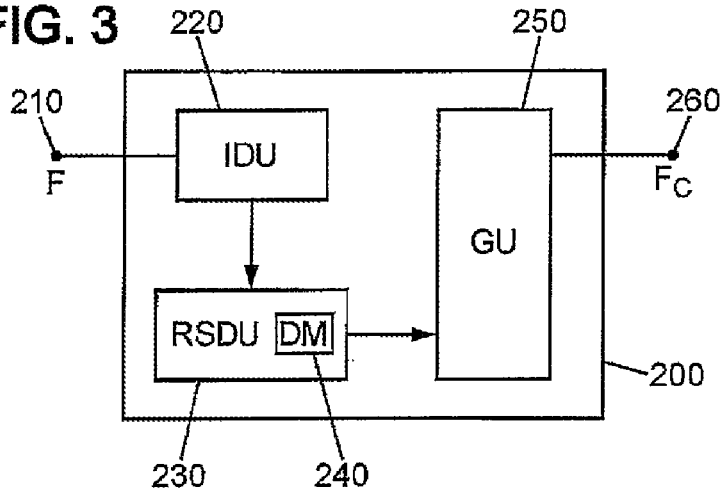
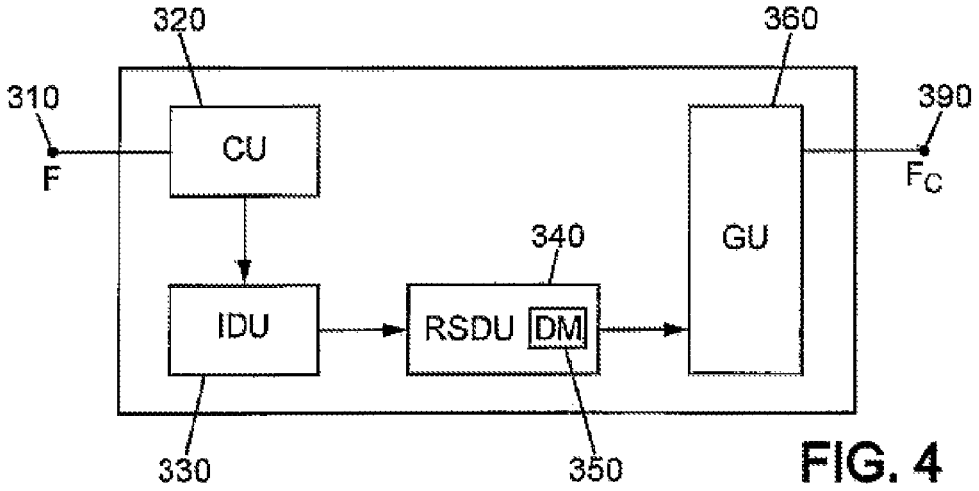
FIG. 4
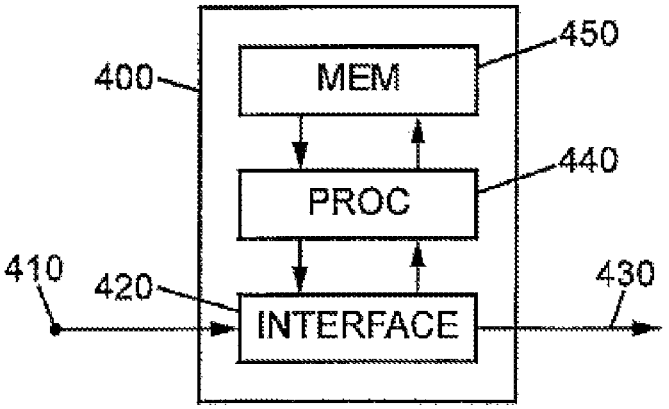
FIG. 5

MULTICHANNEL AUDIO STREAM COMPRESSION

CROSS-REFERENCE TO RELATED APPLICATIONS

This application is the U.S. national phase of the International Patent Application No. PCT/FR2011/050282 filed Feb. 10, 2011, which claims the benefit of French Application No. 1051420 filed Feb. 26, 2010, the entire content of which is incorporated herein by reference.

BACKGROUND

The present invention relates generally to multichannel audio stream compression—i.e. including a plurality of audio signals—intended to be processed by an audio system including a plurality of loudspeakers in order to reproduce a spatialized sound scene. In particular, the compression means are applied to the audio streams encoded according to a multichannel coding format of the 5.1, 6.1, 7.1, 10.2, 22.2 type, or also according to an ambisonic coding format commonly known as "HOA" for "Higher-Order Ambisonics". The HOA ambisonic encoding format is in particular detailed in the document Daniel, J., Acoustic Field Representation, Application to the Transmission and the Reproduction of Complex Sound Environments in a Multimedia Context, 2000, PhD Thesis, University of Paris 6, Paris. The compression applied to the audio streams can in particular be introduced prior to a step of transmission, broadcast or storage, for example on an optical disk.

In order to reduce the quantity of information required to represent a multichannel audio stream, it is possible to encode separately the different signals constituting said stream according to a conventional audio stream compression scheme, generally exploiting the frequency masking properties observed in the perception of a sound signal by a listener. Reference may be made by way of example to "MPEG-1/2 Audio Layer 3" coding, more generally denoted by its acronym MP3, or also "Advanced Audio Coding" or "AAC". As the signals are considered separately, any redundancies between the signals are not exploited to any great extent. This solution is adapted to high bit-rate multichannel audio stream encoding, typically at a bit rate greater than or equal to 128 kbit/s per channel in the case of MP3, 64 kbits/s per channel in the case of AAC. Thus, separate encoding of the signals of a stream is not adapted to the production of streams typically having a bit rate of the order of 64 kbits/s for 5 to 7 channels, without significant reduction in the sound quality level.

Another possible alternative consists of mixing the different streams in order to obtain a mono or stereo signal. This technique is used in particular in low bit-rate "MPEG Surround" encoding i.e. in which the bit rate is typically of the order of 64 kbits/s for 5 to 7 channels. This operation is conventionally known as "downmix" The mono or stereo signal can then be coded according to a conventional compression scheme in order to obtain a compressed stream. Spatial information is moreover calculated then added to the compressed stream. This spatial information is for example the time difference between two channels ("ICTD" for "Inter-Channel Time Difference"), the energy difference between two channels ("ICLD" for "Inter-Channel Level Difference"), the correlation between two channels ("ICC" for "Inter-Channel Coherence").

Coding the mono or stereo signal originating from the "downmix" operation is carried out based on an unsuitable hypothesis of monophonic or stereophonic perception and thus does not take account of the characteristics specific to spatial perception of the multi-channel signal, in particular in the case where the audio stream includes a significant number of channels, typically greater than or equal to 7.

Thus, the inaudible degradation on the signal originating from the "downmix" operation can become audible on a multi-loudspeaker restoration device of the multi-channel stream resulting from the "upmix" processing, in particular on account of the binaural unmasking, described in particular in the document Saberi, K., Dostal, L., Sadralodabai, T., and Bull, V., "Free-field release from masking," Journal of the Acoustical Society of America, vol. 90, 1991, pp. 1355-1370.

A need therefore exists for more efficient compression of spatialized audio streams while retaining a perceived sound quality at least equivalent to the techniques of the state of the art.

SUMMARY

The present invention aims to improve this situation.

According to a first aspect, a method for the compression of an audio stream including a plurality of signals is proposed. The audio stream describes a sound scene produced by a plurality of sources in a space. The method comprises the following steps:

- from the audio stream, identification of the sources;
- determination for each of the identified sources of a frequency band, of an energy level and a spatial position in the space;
- determination, for each identified source, of a spatial resolution corresponding to the smallest position variation of said source in the space that a listener is capable of perceiving, as a function:
  - of the frequency band, the energy level and the spatial position of said source; and,
  - of the frequency band, the energy level and the spatial position of the other identified sources;
- generating a compressed stream comprising the information required to restore each identified source with at least the corresponding spatial resolution.

The method of compression proposes a solution for exploiting the psycho-perceptive and cognitive properties of the spatialized audio perception of a listener for the compression of the multichannel audio stream. Among these properties there can be mentioned the spatial masking of a source that predominates over the other sources, reducing the ability of a listener to locate these latter.

The invention makes it possible to reduce the presence in the audio stream of the sound restoration information that is not exploited by the auditory system of the listener, without risking the introduction of audible artefacts into the spatialized restoration system, unlike the compression techniques of the prior art.

Moreover, the method according to the invention makes it possible to exploit the interactions between the different sources, since the spatial resolution of each source is determined not only as a function of the characteristics of said source, but also as a function of those of the other sources in the space. In comparison with the other compression techniques that process each signal separately, the compression rate achieved proves to be potentially greater.

It is possible to identify, in the space, only the sources audible to a listener, which makes it possible thus to further reduce the information to be coded. For example, using a simultaneous energy/masking analysis taking account of binaural unmasking, a subset of the sound sources is listed. In fact, the non-audible sources do not necessarily need to be considered in the implementation of the psycho-acoustic spatial masking model. Thus, the complexity of the process, in the algorithmic meaning of the term, can be reduced.

In an embodiment, the audio stream signals include information representing the sound scene on a spherical harmonics basis. Alternatively, the method can comprise a step of transposition of the information included in the audio stream signals representing the sound scene on a spherical harmonics basis, thus making it possible to convert the stream.

In this embodiment, the compressed stream can also be generated by subdividing the space into sub-spaces, and by truncating, for each of the sub-spaces, a representative order of the signals on a spherical harmonics basis, until a spatial resolution is obtained that is substantially equal to the maximum value of the spatial resolutions associated with the sources present in the sub-space in question.

The truncation of the representative order of the signals makes it possible to reduce the spatial resolution of the signals representation. In the case of an HOA representation, the sound scene can be described by a set of signals corresponding to the coefficients of decomposition of the acoustic wave on a spherical harmonics basis. This representation has the property of scalability, in the sense that the coefficients are hierarchized and the first-order coefficients contain a complete description of the sound scene. The higher-order coefficients merely detail the spatial information. The truncation of the representative order in this case amounts to eliminating the higher-order components until the determined resolution is achieved.

In this embodiment, the subdivision of the space into sub-spaces can be dynamic over time. A dynamic subdivision makes it possible to group, in a single sub-space, adjacent sources of spatial resolution perceived in a similar way.

In a particular embodiment, the different steps of the compression methods are determined by computer program instructions.

Consequently, the invention also relates to computer programs on an information storage medium, these programs being capable of implementation respectively in a computer, these programs comprising respectively instructions adapted to the implementation of the steps of the above-described compression methods.

These programs can use any programming language, and be in the form of source code, object code, or intermediate code between source code and object code, such as in a partially-compiled form, or in any other desirable form.

The invention also relates to a computer-readable information storage medium comprising instructions of a computer program such as mentioned above.

The information storage medium can be any entity or device capable of storing the program. For example, the media can comprise a storage means, such as a ROM, for example a CD ROM or a microelectronic circuit ROM, or also a magnetic recording means, for example a floppy disc or a hard drive.

Moreover, the information storage medium can be a transmissible medium such as an electrical or optical signal, which can be conveyed via an electrical or optical cable, by radio or by other means. The program according to the invention can in particular be downloaded over a network of the internet type.

Alternatively, the information storage medium can be an integrated circuit in which the program is incorporated, the circuit being adapted to execute or to be used in the execution of the methods in question.

According to a second aspect, a multichannel audio stream compression device is proposed, adapted to the implementation of the method according to the first aspect. The device includes an input for receiving a multichannel audio stream describing a sound scene produced by a plurality of sources in a space, and an output for delivering a compressed stream. The device moreover contains:

- a unit for identification of the sources, coupled to the input, adapted to identify the sources from the stream and to determine for each of the identified sources a frequency band, an energy level and a spatial position in the space;
- a unit for the determination of spatial resolution, coupled to the identification unit, adapted to determine, for each identified source, a spatial resolution corresponding to the smallest position variation of said source in the space that a listener is capable of perceiving, as a function
  - of the frequency band, the energy level and the spatial position of said source; and,
  - of the frequency band, the energy level and the spatial position of the other identified sources;
- a unit for the generation of the compressed stream, coupled to the unit for the determination of spatial resolution, adapted to form the compressed stream from the information required to restore each identified source with at least the corresponding spatial resolution, and deliver the compressed stream at the output.

The identification unit can be configured to identify only the audible sources.

In an embodiment, the generation unit can be adapted to produce the compressed stream from the signals when the latter comprise information representing the sound scene on a spherical harmonics basis by:

- subdividing the space into sub-spaces, and
- truncating, for each of the sub-spaces, a representative order of the signals on a spherical harmonics basis, until a spatial resolution is achieved that is substantially equal to the maximum value of the spatial resolutions associated with the sources present in the sub-space in question.

The generation unit can be configured to adapt the subdivision of the space into sub-spaces over time.

In an embodiment, the device includes moreover a conversion unit adapted for transposing information included in the audio stream signals on a spherical harmonics basis.

BRIEF DESCRIPTION OF THE DRAWINGS

Other aspects, purposes and advantages of the invention will become apparent on reading the description of one of its embodiments.

The invention will also be better understood with the help of the drawings, in which:

FIG. 3 shows, in a schematic diagram, a multichannel audio stream compression device;

FIG. 4 shows, in a schematic diagram, a multichannel audio stream compression device, according to another embodiment;

FIG. 5 illustrates, in a schematic diagram, a processing device for implementing the compression method.

DETAILED DESCRIPTION

In the present description, there is considered a sound scene SCE, i.e. an actual acoustic field, formed by sound signals emitted by a plurality of sources SR, or a synthetic acoustic field obtained by artificial spatialization of monophonic signals. The signal emitted by a sound source or source can be represented by a spatial energy distribution in a frequency band. When the spatial energy distribution is correlated and contiguous in the space, the corresponding source is then described as an extended source; in the opposite case the source is called a point source. The sound scene is captured by a limited number of sound sensors, in order to form a multichannel audio stream F comprising a plurality of signals S. Alternatively the scene can be synthesized by spatialization of monophonic signals. The stream F can be subdivided into timeframes T. The stream F can be considered as a description or representation over time of the sound scene SCE. The spatial components of the sound scene SCE can be represented in the field HOA by projected spatial components on a spherical harmonics basis. By the term ambisonic encoding is meant the step consisting of obtaining these spatial components of the field on a spherical harmonics basis. This encoding thus makes it possible to represent the sound scene in the form of ambisonic signals.

Figure 1:
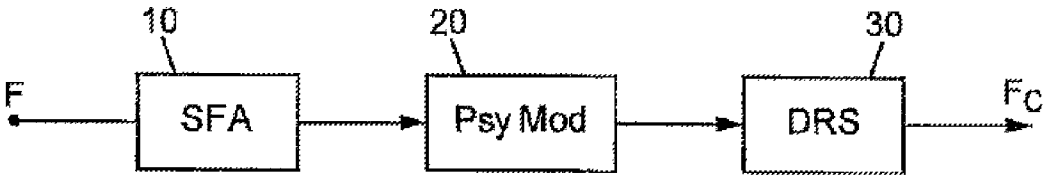
FIG. 1 illustrates, in a functional block diagram, the main steps of the compression method applied to a multichannel audio stream.

The main steps of the compression method applied to the stream F are represented in FIG. 1.

In a step 10, by spatial/frequency analysis of the signals S, the sources SR are identified and for each identified source SR, a frequency band of the source or the central frequency of said frequency band, an energy level and a spatial position are identified.

In order to identify the sources, a time/frequency analysis of each of the signals S constituting the stream F can in particular be carried out in order to extract an energy level per frequency band for each frame T. The results of a time/frequency analysis carried out prior to the implementation of the method according to the invention, for example during a possible compression of the signals S by frequency masking techniques, can also be used during step 10 to identify the sources SR.

During step 10, each identified source SR is associated with the following variables: its frequency band of the source or the central frequency of said frequency band, its energy level and its spatial position. In particular, the frequency band of the source or the central frequency of said frequency band can be obtained directly, following the time/frequency analysis implemented to identify each source SR.

Suitable methods of identification or separation of sources are described in the document Arberet, S. "Robust estimation and blind learning of models for audio source separations", Thesis of the University of Rennes 1, 2008, or beam formation methods, such as that described in the document Veen, B. D. V. & Buckley, K. M. "Beamforming: a versatile approach to spatial filtering" IEEE ASSP Magazine, 1988, 4-24. If the source SR in question is an extended source, the spatial position can correspond to the spatial barycenter of said extended source, and measurement of the width of the spatial extent of said source is also carried out. Optionally, it is possible to select only a subset of the sources SR identified during step 10. For example, only the sources SR that are audible to an average listener will be selected. To determine if a source is audible, it is possible in particular to implement a simultaneous energy/masking analysis, taking account of the binaural unmasking, such as that described in particular in the document Saberi, K., Dostal, L., Sadralodabai, T., and Bull, V., "Free-field release from masking," Journal of the Acoustical Society of America, vol. 90, 1991, pp. 1355-1370.

In a step 20, a spatial resolution RS is calculated for each of the sources SR identified during step 10, by implementation of a psycho-acoustic model. The spatial resolution RS calculated for a source corresponds to an optimal resolution beyond which an average listener perceives no significant increase in the level of precision in the location of said source. The spatial resolution RS corresponds also to a maximum spatial degradation applicable to the corresponding source SR, without substantial degradation of the ability of a listener to locate said source SR, in the presence of the other sources SR.

By way of non-limitative example, if the spatial resolution RS is equal to 1 degree for one of the sources SR, it will be assumed that the listener is unable to locate said source SR with a precision greater than 1 degree.

The psycho-acoustic model returns an adapted spatial resolution according to the characteristics of the source SR in question. Thus an individual spatial resolution RS corresponds to each source SR. The spatial resolution RS of one of the sources SR can also be defined as the minimum audible angle associated with said source RS, for example in the meaning of the 1958 Mills experiment reported in the document A. W. Mills, "On the Minimum Audible Angle", The Journal of the Acoustical Society of America, vol. 30, April 1958, pp. 237-246. According to this definition, the minimum audible angle of the source SR is substantially equivalent to the measurement carried out under the same conditions as those described in the Mills experiment, for a target source in the meaning of A. W. Mills, having the same characteristics as the source RS.

The spatial resolution RS associated with one of the sources SR is a function in particular of the following parameters:

- the central frequency of the frequency band of the source SR;
- the energy level of the source SR;
- the spatial position of the source SR;
- the central frequency of the frequency band of each of the other sources SR;
- the energy level of each of the other sources SR;
- the spatial position of each of the other sources SR.

The psycho-acoustic model can therefore be described by a function $f(s_c, sd_1, sd_2, \ldots, sd_N)$, where $s_c$ represents the source SR for which it is desired to obtain the spatial resolution RS, and $sd_1, sd_2, \ldots sd_N$ represents all or part of the other sources SR. The sources SR can each be described by a quadruplet $\{f_c, I, \theta, \phi\}$, where $f_c$ represents the central frequency, I the energy level, $\theta$ the azimuth angle position, and $\phi$ the elevation angle position.

The psycho-acoustic model can moreover be constructed from models describing the capacities of a listener as a function of the above-described parameters, and/or from test results. For the construction of the model, it is moreover possible to adopt the hypothesis that the listener is always facing the source SR for which the spatial resolution RS is calculated; i.e. the case in which the capacity of the listener to separate the sources is maximum.

In a step 30, a compressed stream $F_c$ is generated comprising compressed signals $S_C$, such that the compressed stream $F_c$ comprises the information required to restore each source SR with the corresponding spatial resolution RS, calculated during step 20. This also amounts to generating the compressed stream $F_c$ by reducing the quantity of spatial information initially contained in the stream F for each source SR, until the information required to restore each source SR with at least the corresponding spatial resolution RS is retained. It is therefore appropriate to note that the compressed stream Fc consequently comprises a quantity of information less than the stream F.

By way of non-limitative example, if the spatial resolution RS is equal to 1 degree for one of the sources SR, it will be assumed that said source SR must be encoded in the compressed stream $F_C$ so as to allow an average listener to locate the source SR with a precision of 1 degree during its restoration by an audio system. Moreover, it will be noted in this example that encoding the source SR with a higher resolution, for example 0.5 degree, will not provide a substantial increase in the ability of the listener to locate the source SR with greater precision. For example, if the stream F includes the information required to achieve a resolution of 0.5 degrees for the source SR, the compressed stream $F_C$ will include only the information required to restore the source SR with a precision of 1 degree.

Figure 2:
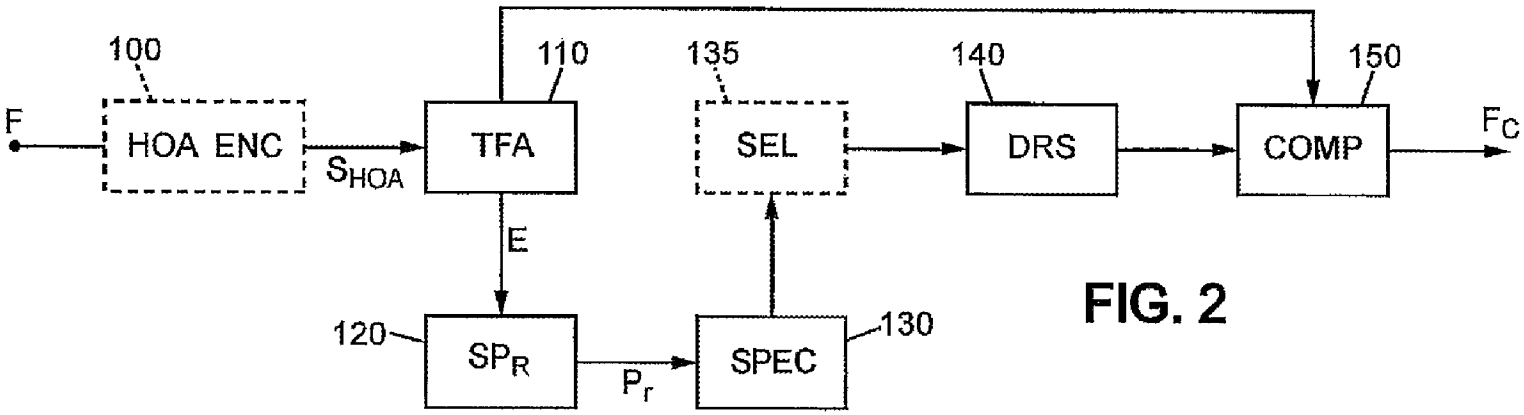
FIG. 2 illustrates, in a functional block diagram, the steps of an embodiment of the compression method, on a spherical harmonics basis, for example in the HOA field, applied to a multichannel audio stream.

FIG. 2 illustrates the steps of an embodiment of the compression method, on a spherical harmonics basis, for example in the HOA field, applied to the stream F.

The method can comprise a transformation step 100, on a spherical harmonics basis, of the stream F. This step 100 is optional if the stream F is already encoded on a spherical harmonics basis. Typically, this transformation can correspond to a projection of the information included in the signals S on a spherical harmonics basis.

In an embodiment of step 100, an acoustic wave corresponding to the one that would be obtained by an audio restoration system fed by the signals S of the stream F is simulated. The simulated acoustic wave is then decomposed on a spherical harmonics basis, by projection on this basis, or by simulation of a synthetic sound capture by an HOA encoding device such as a spherical microphone array. The latter possibility is for example described in the document Moreau, S. "Etude et réalisation d'outils avancés d'encodage spatial pour la technique de spatialisation sonore Higher Order Ambisonics: microphone 3D et contrôle de la distance" ["*Research and realization of advanced spatial encoding tools for the Higher Order Ambisonics spatialization technique: 3D microphone and distance control*"] University of Maine, Le Mans, France, 2006. Thus decomposition coefficients C forming signals $S_{HOA}$ corresponding to the signals S in an HOA encoding format are obtained.

The method comprises a step 110 of time/frequency analysis of the signals $S_{HOA}$ in order to extract an energy level E for each signal $S_{HOA}$, for each frame T, and for each frequency band.

The method comprises a step 120 during which a spatial projection Pr of the energy levels E on a sphere is calculated for each frame T and for each frequency band. Thus a model is obtained making it possible to determine the energy level E as a function of the direction, for each frame T and for each frequency band. It is possible in particular to calculate the spatial projection Pr of the energy level E by carrying out a reverse transformation of the signals $S_{HOA}$ in a field of space variables. For example, an acoustic wave corresponding to the signals $S_{HOA}$ is reconstructed by linear combination of the spherical harmonics weighted by the values of the HOA components. Thus a spatial evolution of the acoustic wave on a sphere is obtained. The spatial projection Pr of the energy levels is then constructed by spatially sampling the sphere, the number of samples chosen being a function of the desired resolution.

The method comprises a step 130 during which, for each frame T, the sources SR, their spatial position and their respective energy are identified. To this end, all the directions of the spatial projection Pr for which the energy level E is non-zero are sought. Then, for each direction in which the energy level is non-zero, the correlation with the energy levels present in the neighbouring directions is calculated. For example, for each frequency band, the energy fluctuations over time are determined, optionally by taking account of the frames T preceding and/or following said frame T, for each direction. In order to increase the temporal precision, it is possible to calculate the correlation over coincident temporal ranges, then to sub-sample the results thus obtained for the frequency band.

If the energy level is correlated for a set of directions, an extended source is identified in said directions, and the corresponding energy level is calculated by adding the energy levels associated with the set of directions. If the energy level is not correlated with the energy levels present in the neighbouring directions, a source is identified and the energy level corresponds to the one given by the spatial projection Pr in this direction. At the outcome of step 130, it is thus possible to describe the sound scene SCE in the form of a set of sources SR of which the position, the spatial extent and the energy are known.

In an optional step 135, a subset of the sources SR identified during step 130 is selected. For example, only the sources SR that are audible to an average listener will be selected. To determine if a source is audible, it is possible in particular to implement a simultaneous energy/masking analysis taking account of the binaural unmasking.

In a step 140, using a psycho-acoustic spatial masking model, for each identified source SR during step 130 and optionally selected during step 135, the corresponding spatial resolution RS is determined Typically, for a frame T, the masking capability in each region of the space and in each frequency band of each identified source SR is assessed vis-à-vis the other identified sources SR. More specifically, for each identified source SR, as a function in particular of its position, frequency band and energy level, the spatial resolution RS with which the source SR is perceived is determined.

In a step 150, the compressed stream $F_c$ is generated comprising the compressed signals $S_C$, such that the compressed stream $F_c$ includes the information required to restore each source SR with at least the corresponding spatial resolution RS, calculated during step 140. This operation amounts to compressing the stream F by adapting the spatial resolution of the signals $S_{HOA}$ as a function of the spatial resolution RS obtained for each identified source SR. In an embodiment of step 150, the space is decomposed into a set of sub-spaces, such that when joined, the sub-spaces are substantially equal to the space. For each of these sub-spaces, a sub-base of spherical harmonics is constructed. For example, a suitable construction method can be that described in the document Pomberger H. & Zotter F. "An Ambisonics format for flexible playback layouts" Ambisonics Symposium 2009, 2009. The functions pertaining to the spherical harmonics base of the whole space are recombined in order to form, for each of the sub-spaces, a sub-base representing this sub-space only. On the basis of the signals obtained in step 110, for a given one of the frames T and a given frequency band, by projecting the energy in this frequency band onto each of the sub-bases representing the sub-spaces, a set of representations is obtained supplementary to the original representation, each restricted to one of the sub-spaces. The decomposition of the space can be either static or can vary from one frame T to another. A dynamic decomposition has the advantage of the ability to group in a single sub-space adjacent sources the perceived spatial resolution of which is substantially equal. Then, for each of the sub-spaces, truncation of a representative order of the signals $S_{HOA}$ in the spherical harmonics base is carried out until a spatial resolution is achieved corresponding to the maximum value of the spatial resolutions RS associated with the sources SR present in the sub-space in question.

It is also possible, in addition to the degradation of spatial resolution in the compressed stream $F_c$ with respect to the stream F, to compress the compressed stream $F_C$ by exploiting the energy-masking information. However, and in order to take account of the effects of binaural unmasking, it is convenient to adopt the most unfavourable case in terms of masking by assuming:

on the one hand the lowest masking threshold from those of all the sources SR present in the sub-space in question.;

and jointly, for each source SR, its lowest masking threshold due to its spatial position in the sub-space in question.

FIG. 3 shows, in a schematic diagram, a multichannel audio stream compression device 200, according to an embodiment. The device 200 is in particular suitable for implementing the method according to the invention.

As represented in FIG. 3, the device 200 includes an input 210 for receiving the multichannel audio stream F describing the sound scene SCE produced by a plurality of sources SR in a space. The device 200 delivers the compressed stream $F_C$ at an output 260.

The device 200 includes an identification unit 220 of the sources SR coupled to the input 210 so as to receive the stream F. The identification unit 220 is adapted to identify the sources SR from the stream F, and to determine for each of the identified sources SR a frequency band, an energy level and a spatial position in the space. The identification unit 220 delivers, at an output, the frequency band, the energy level and the spatial position in the space of each identified source SR. In particular, the identification unit 220 can be configured to identify only the audible sources SR.

The device 200 comprises a determination unit 230 of the spatial resolution RS, coupled to the output of the identification unit 220, corresponding to the smallest position variation of said source in the space that a listener is capable of perceiving. The determination unit 230, with the aid for example of a psycho-acoustic model 240, provides at an output the spatial resolution RS for each identified source SR, as a function:

of the frequency band, the energy level and the spatial position of said source; and, of the frequency band, the energy level and the spatial position of at least one subset of the other identified sources.

The device 200 comprises a generation unit 250, coupled to the output of the identification unit 220, adapted for forming the compressed stream $F_C$ from the information required to restore each identified source SR with at least the corresponding spatial resolution RS.

FIG. 4 shows, in a schematic diagram, a multichannel audio stream compression device 300, according to an embodiment. As represented in FIG. 4, the device 300 includes an input 310 for receiving the multichannel audio stream F describing the sound scene SCE produced by a plurality of sources SR in a space. The device 300 delivers the compressed stream $F_C$ at an output 390.

The device 300 can include a conversion unit 320 adapted for transposing information comprised in the signals S of the audio stream F representing the sound scene SCE on a spherical harmonics basis, when the stream F includes signals S intended to feed loudspeakers directly, such as for example signals S of type 5.1, 6.1, 7.1, 10.2, 22.2. The conversion unit 320 delivers at the output described $S_{HOA}$ signals on a spherical harmonics basis.

The device 300 comprises an identification unit 330 of the sources SR coupled to the output of the conversion unit 320 for receiving the signals $S_{HOA}$. The identification unit 330 is adapted to identify the sources SR from the stream F, and to determine for each of the identified sources SR a frequency band, an energy level and a spatial position in the space. To this end, the identification unit 330 is configured to calculate a spatial projection of the energy levels of the sources on a sphere and to seek the directions of the spatial projection of which the energy level is non-zero. The identification unit 330 delivers, at an output, the frequency band, the energy level and the spatial position in the space of each identified source SR. In particular, the identification unit 330 can be configured to identify only the audible sources SR.

The device 300 comprises a determination unit 340 of the spatial resolution RS, coupled to the output of the identification unit 330, corresponding to the smallest position variation of said source in the space that a listener is capable of perceiving. The determination unit 340, with the aid for example of a psycho-acoustic model 350, delivers at an output the spatial resolution RS for each identified source SR, as a function:

of the frequency band, the energy level and the spatial position of said source; and, of the frequency band, the energy level and the spatial position of at least one subset of the other identified sources.

The device 300 comprises a generation unit 360, coupled to the output of the identification unit 340, adapted to form the compressed stream $F_C$ from the information required to restore each identified source SR with at least the corresponding spatial resolution RS. The generation unit 360 is in particular adapted to produce the compressed stream $F_c$ by subdividing the space into sub-spaces, and by truncating, for each of the sub-spaces, a representative order of the signals on a spherical harmonics basis, until a spatial resolution is obtained that is substantially equal to the maximum value of the spatial resolutions associated with the sources presented in the sub-space in question. The subdivision of the space into sub-spaces can moreover be dynamic over time.

FIG. 5 represents a processing device 400 for implementing the compression process according to the invention.

The device 400 includes an interface 420 coupled to an input 410 for receiving the stream F and an output F for delivering the compressed stream $F_c$. The interface 420 is for example an interface for accessing a communications network, a storage device, and/or also a media reader.

The device 400 also includes a processor 440 coupled to a memory 450. The processor 440 is configured for communicating with the interface 420. In particular, the processor is adapted to execute computer programs, included in the memory 450, comprising respectively instructions adapted to the implementation of the steps of the above-described compression methods. The memory 450 can be a combination of elements chosen from the following list: a RAM, a ROM, for example a CD ROM or a microelectronic circuit ROM, or also a magnetic recording means, for example a diskette or a hard drive, a transmissible medium such as an electrical or optical signal which can be conveyed via an electrical or optical cable, by radio or by other means. The program can in particular be downloaded over a network of the internet type. Alternatively, the memory 450 can be an integrated circuit in which the program is incorporated, the circuit being adapted to execute or to be used in the execution of the processes in question.

The invention claimed is:

1. A method for the compression of an audio stream comprising a plurality of signals, said audio stream describing a sound scene produced by a plurality of sources in a space, the method comprising the following steps:

from the audio stream, identification of the sources;

determination, for each of the identified sources of a frequency band, an energy level and a spatial position in the space;

determination, for each identified source, of a spatial resolution corresponding to an optimal resolution beyond which an average listener perceives no increase in the level of precision in the location of said identified source, as a function:

of the frequency band, the energy level and the spatial position of said source; and, of the frequency band, the energy level and the spatial position of the other identified sources;

generation of a compressed stream comprising the information required to restore each identified source with at least the corresponding spatial resolution.

2. The method according to claim 1, wherein the step of identification of the sources comprises a step of identification of only the audible sources.

3. The method according to claim 1, wherein the audio stream signals include information representing the sound scene on a spherical harmonics basis.

4. The method according to claim 1, wherein the method comprises a transposition step of the information included in the audio stream signals representing the sound scene on a spherical harmonics basis.

5. The method according to claim 3, wherein the step of generation of the compressed stream is effected by subdividing the space into sub-spaces, and by truncating, for each of the sub-spaces, a representative order of the signals on a spherical harmonics basis, until a spatial resolution is obtained that is substantially equal to the maximum value of the spatial resolutions associated with the sources present in the sub-space in question.

6. The method according to claim 5, wherein the subdivision of the space into sub-spaces is dynamic over time.

7. A non-transitory computer program product comprising instructions for implementing the method according to claim 1 when this program is executed by a processor.

8. A computer-readable information storage medium comprising the instructions of the non-transitory computer program product according to claim 7.

9. A multichannel audio stream compression device, including an input for receiving a multichannel audio stream describing a sound scene produced by a plurality of sources in a space, and an output for delivering a compressed stream, the device comprising:

an identification unit of the sources, coupled to the input, adapted to identify the sources from the streams, and to determine for each of the identified sources a frequency band, an energy level and a spatial position in the space;

a determination unit of spatial resolution, coupled to the identification unit, adapted to determine, for each identified source, a spatial resolution corresponding to an optimal resolution beyond which an average listener perceives no increase in the level of precision in the location of said identified source, as a function of the frequency band, the energy level and the spatial position of said source; and, of the frequency band, the energy level and the spatial position of the other identified sources;

a generation unit of the compressed stream, coupled to the determination unit of spatial resolution, adapted to form the compressed stream from the information required to restore each identified source with at least the corresponding spatial resolution, and deliver the compressed stream at the output.

10. The device according to claim 9, wherein the identification unit is configured to identify only the audible sources.

11. The device according to claim 9, wherein the generation unit is adapted to produce the compressed stream from the signals when these latter comprise information representing the sound scene on a spherical harmonics basis by:

subdividing the space into sub-spaces, and truncating, for each of the sub-spaces, a representative order of the signals on a spherical harmonics basis, until a spatial resolution is achieved that is substantially equal to the maximum value of the spatial resolutions associated with the sources present in the sub-space in question.

12. The device according to claim 11, wherein the generation unit is configured to adapt the subdivision of the space into sub-spaces over time.

13. The device according to claim 11, further comprising a conversion unit adapted for transposing information included in the audio stream signals on a spherical harmonics basis.

* * * * *